US005866883A

United States Patent [19]

Hirai

[11] Patent Number: 5,866,883

[45] Date of Patent: Feb. 2, 1999

[54] CERAMIC HEATER

[75] Inventor: Sadaaki Hirai, Nagoya, Japan

[73] Assignee: NGK Insulators, Ltd., Nagoya, Japan

[21] Appl. No.: 957,132

[22] Filed: Oct. 24, 1997

[30] Foreign Application Priority Data

Oct. 29, 1996 [JP] Japan ..... 8-286973

[51] Int. Cl.[6] ..... H05B 3/44

[52] U.S. Cl. ..... 219/544; 219/553; 219/541; 219/552; 338/22 R

[58] Field of Search ..... 219/544, 541, 219/553, 552, 505, 220; 338/22 R; 392/491; 501/98.4, 98.5, 96

[56] References Cited

U.S. PATENT DOCUMENTS

| | | | |
|---|---|---|---|
| 4,357,526 | 11/1982 | Yamamoto et al. | 219/544 |
| 4,804,823 | 2/1989 | Okuda et al. | 219/553 |
| 5,264,681 | 11/1993 | Nozaki et al. | 219/544 |
| 5,470,506 | 11/1995 | Tanigami et al. | 252/518 |
| 5,498,855 | 3/1996 | Deevi et al. | 219/553 |
| 5,710,381 | 1/1998 | Atwood et al. | 73/864.91 |

FOREIGN PATENT DOCUMENTS

| | | |
|---|---|---|
| 6-99085 A | 4/1994 | Japan . |
| 6-210189 A | 8/1994 | Japan . |

OTHER PUBLICATIONS

Patent Abstracts of Japan, Japanese Publication No. 06–210189A, Publication Date: Feb. 8, 1994.

Database WPI, Section Ch, Week 9543, Derwent Publ. Ltd., AN 95–334104, XP–002053090, Abstract of Japanese Patent Publications No. 07 230 876A, Publication Date: Aug. 29, 1995.

*Primary Examiner*—Teresa J. Walberg
*Assistant Examiner*—Vinod D. Patel
*Attorney, Agent, or Firm*—Kubovcik & Kubovcik

[57] ABSTRACT

A ceramic heater includes a body of aluminum nitride, and a heating element embedded in the body of aluminum nitride. The heating element has a resistance of $(E^2/W)\cdot 0.003\Omega$ to $(E^2/W)\cdot 0.135\Omega$ (E and W denote an input voltage (unit: V) and a weight (unit: g) of the body of aluminum nitride, respectively).

16 Claims, 2 Drawing Sheets

CERAMIC HEATER

BACKGROUND OF THE INVENTION AND RELATED ART STATEMENT

The present invention relates to a ceramic heater which is widely used in, for example, a field related to biotechnology such as molecular biology and genetic engineering and a field of physical and chemical research with regard to medical treatment, the food industry, or the like.

In a field such as a field related to biotechnology such as molecular biology and genetic engineering, a field of physical and chemical research with regard to medical treatment, the food industry, or the like, is a constant-temperature vessel is indispensable for heating a sample in a test tube or a microtube and keeping the sample at a fixed temperature. Such a constant-temperature vessel needs high temperature precision. This is because most experiments in the above fields concern enzyme reactions, each enzyme has an optimum temperature, and an enzyme is inactivated at a temperature higher than a definite temperature. Further, in a field of genetic engineering, when mutually complementary nucleic acid molecules, or the like, are subjected to annealing, or when nucleic acid molecules each having two chains are dissociated so as to have single chain, it is necessary to control temperatures strictly.

Further, such a constant-temperature vessel is required to reach a predetermined temperature in a short period of time. If the time is too long, it is not efficient because an unacceptable time is required for a completion of one experiment when a temperature of the constant-temperature vessel has to be frequently changed as in a PCR (Polymerase Chain Reaction) method, which is a genetic amplification method used widely in genetic engineering. Further, when a plurality of experiments are conducted in parallel and each constant-temperature vessel has an independent predetermined temperature, the experiments cannot be effectively conducted if the time until a temperature reaches a predetermined one is too long.

As a constant-temperature vessel having such properties, there have conventionally been used a constant-temperature water vessel, an aluminum block constant-temperature vessel, or the like. A constant-temperature water vessel is a cistern being provided, therein, with a heater for heating water. In an aluminum block constant-temperature vessel is an aluminum block having a cavity for receiving an object to be heated by a heater on the outside.

In recent years, there has been proposed a heater in which a heating element is embedded in a ceramic block of aluminum nitride and a cavity for receiving an object to be heated on a surface of the block, which make use of an excellent heat conductivity of aluminum nitride (Japanese Patent Laid-Open 6-210189).

However, there are some problems. Since a test tube, or the like, is directly put in a liquid in the constant-temperature water vessel, the outer wall of the test tube gets wet and water on the outer wall has to be wiped off before the next step. Besides, water on the outer wall sometimes enters in the test tube, and it causes a contamination.

With respect to an aluminum block constant-temperature vessel, it has low temperature precision and a variance in temperature distribution is large because it is heated by a heater on the outside. Accordingly, it is difficult to control conditions for an experiment. Sometimes, a temperature in the constant-temperature vessel exceeds a predetermined temperature, and an enzyme is prone to be inactivated in an enzyme reaction.

Further, both a constant-temperature water vessel and an aluminum block constant temperature vessel need a long time to reach a predetermined temperature. For example, it takes about 100 seconds to raise 100° C. Accordingly, a time length until the constant-temperature vessel reaches a predetermined temperature is a rate-determining condition of an experiment, and the experiment cannot effectively proceed.

On the other hand, a ceramic heater using aluminum nitride solves the problems that an outer wall of a test tube gets wet and that a variance in temperature distribution is large, a temperature of the ceramic heater reaches a predetermined one in a shorter time. However, there is a problem that it takes about 50 seconds for a rise of 100° C.

In view of these situations, the present invention aims to provide a ceramic heater which can be heated up to a predetermined temperature in a short time and is excellent in temperature precision without hindrance to an enzyme reaction, or the like, by keeping the temperature so as not to exceed a predetermined one.

SUMMARY OF THE INVENTION

According to the present invention, there is provided a ceramic heater comprising:

a body of aluminum nitride, and a heating element embedded in said body of aluminum nitride;

wherein said heating element has a resistance of $(E^2/W)\cdot 0.003\Omega$ to $(E^2/W)\cdot 0.135\Omega$ (E and W denote an input voltage (unit: V) and a weight (unit: g) of the body of aluminum nitride, respectively).

The heating element is preferably made of tungsten or molybdenum.

DETAILED DESCRIPTION OF PREFERRED EMBODIMENT

In a ceramic heater of the present invention, a heating element is embedded in a body of aluminum nitride. A resistance of the heating element is set to be from $(E^2/W)\cdot 0.003\Omega$ to $(E^2/W)\cdot 0.135\Omega$.

By specifying a resistance of the heating element in the above range, for example, even such a short time of 10 seconds or less can raise a temperature of the ceramic heater 100° C. Accordingly, an efficiency of experiments can be greatly improved.

Further, since a resistance of the heating element is $(E^2/W)\cdot 0.003\Omega$ or more, an electric current right after electrification is restricted, thereby controlling a sudden generation of heat at an early stage of electrification. Thus, it has an advantage of controlling a temperature with high precision. Accordingly, it can avoid inactivation of enzymes which is caused because of a temperature of the heater being higher than a predetermined temperature.

In a ceramic heater of the present invention, TaN, TiN, or the like, suitably used as a material for a heating element. It is preferable, however to use a material made of tungsten or molybdenum in view of a high melting point and a shrinkage rate during sintering.

The ceramic heater has at least one cavity for receiving an object to be heated on a surface of the ceramic heater.

When the cavity for receiving an object to be heated is formed, a configuration and a size of the cavity preferably match those of a test tube, microtube, etc., to be used in view of thermal efficiency upon transmitting heat of a heater to the object to be heated.

An example of a method for producing a ceramic heater of the present invention is described below.

A ceramic heater of the present invention is produced by the steps of:

forming a pattern by printing a paste consisting of a heating element material on a ceramic compact;

embedding the pattern by a) covering the pattern with the same quality of ceramic powder and subject the compact to another press molding, b) superposing a same quality of ceramic press compact on the compact, or c) subjecting the ceramic compact to CIP (Cold Isostatic Pressing) connection with a same quality of ceramic press compact;

firing the ceramic compact to obtain a sintered body;

machining a surface of the sintered body so as to have a desired configuration and size; and connecting a lead wire to a terminal of the aforementioned pattern.

Incidentally, a resistance is set up by adjusting a width and a thickness of the aforementioned pattern.

The present invention is hereinbelow described with reference to embodiments shown in the attached drawings. However, the present invention is by no means limited to these embodiments.

(EXAMPLE 1)

Figure 1:
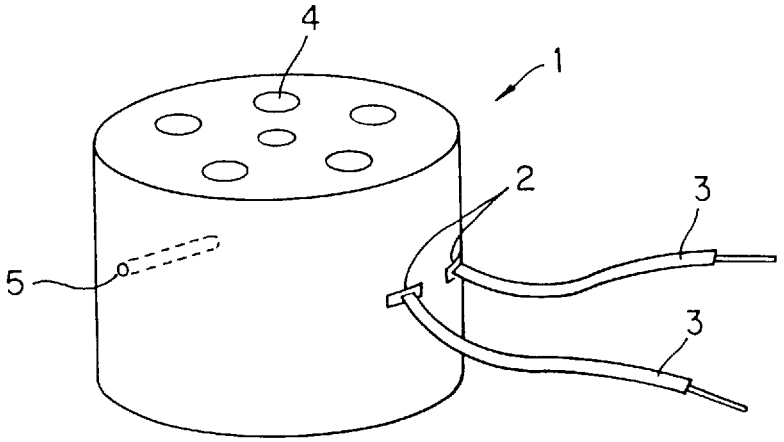
FIG. 1 is a perspective view showing an embodiment of a ceramic heater.

As shown in FIG. 1, a columnar ceramic heater 1 having a weight of 39.7 g was produced by a method shown below and measured for a time until a temperature reaches a predetermined one and for temperature precision.

First, to 100 wt % of aluminum nitride powder having an average particle diameter of 1 $\mu$m was added 5 wt % of $Y_2O_3$ powder as a sintering aid and 3 wt % of a wax as a binder. They were sufficiently mixed together in a dispersion medium to obtain a material, and then the material was granulated by a spray drying using spray drier so as to obtain a material powder having an average particle diameter of 60–80 $\mu$m and good flowability.

Subsequently, the material powder was molded by a press molding (uniaxial pressing) under a pressure of 200 kg/cm$^2$ so as to obtain a compact.

Then, a pattern consisting of a heating element material was formed on the aforementioned compact by a screen printing using a tungsten paste. Incidentally, the tungsten paste was prepared by sufficiently mixing tungsten powder with poly(vinyl butyral), 2-ethylhexyl phthalate, 2-ethyl hexanol, etc., in a dispersion medium and subsequently volatilizing the dispersion medium. Incidentally, a resistance of the heating element was adjusted to be 0.8Ω when an input voltage is 100V, i.e., $(E^2/W)\cdot 0.003\Omega$ (in the case of this embodiment, 0.76Ω because the weight of the ceramic heater is 39.7 g) or more and $(E^2/W)\cdot 0.135\Omega$ (in the case of this embodiment, 34.0Ω) or less by changing a width and a thickness of the pattern.

Subsequently, a compact on which the pattern was formed was covered with a ceramic powder prepared in the same manner as the material powder used for molding the compact on which the pattern was formed. The ceramic powder was subjected to press molding under a pressure of 200 kg/cm$^2$ so as to embed the pattern.

Then, the compact was heated up to 500° C. at a speed of 50° C./hour in a hydrogen gas, and then a binder was removed by keeping the compact at 500° C. for 2 hours so as to obtain a degreased compact.

The degreased compact was put in a vacuum pack to be subjected to a cold isostatic press (CIP) under a pressure of 7 ton/cm$^2$.

Then, the compact was heated up to 1400° C. at a speed of 700° C./hour in a nitrogen atmosphere under a pressure of 0.5 kg/cm$^2$ so as to be fired. The firing was further conducted by heating up to 1900° C. at a speed of 300° C./hour and maintaining the temperature for three hours so as to obtain a sintered body.

The sintered body was subjected to machining (grinding) so as to obtain a columnar configuration having a diameter of 34 mm and height of 13 mm and having a plurality of cavities 4 on its surface. Incidentally, machining may be conducted before firing in consideration of a shrinkage rate by firing.

Finally, a copper cable 3 was connected to a terminal 2 of the heating element exposed in a connected portion of the sintered body so as to obtain a ceramic heater.

Figure 2:
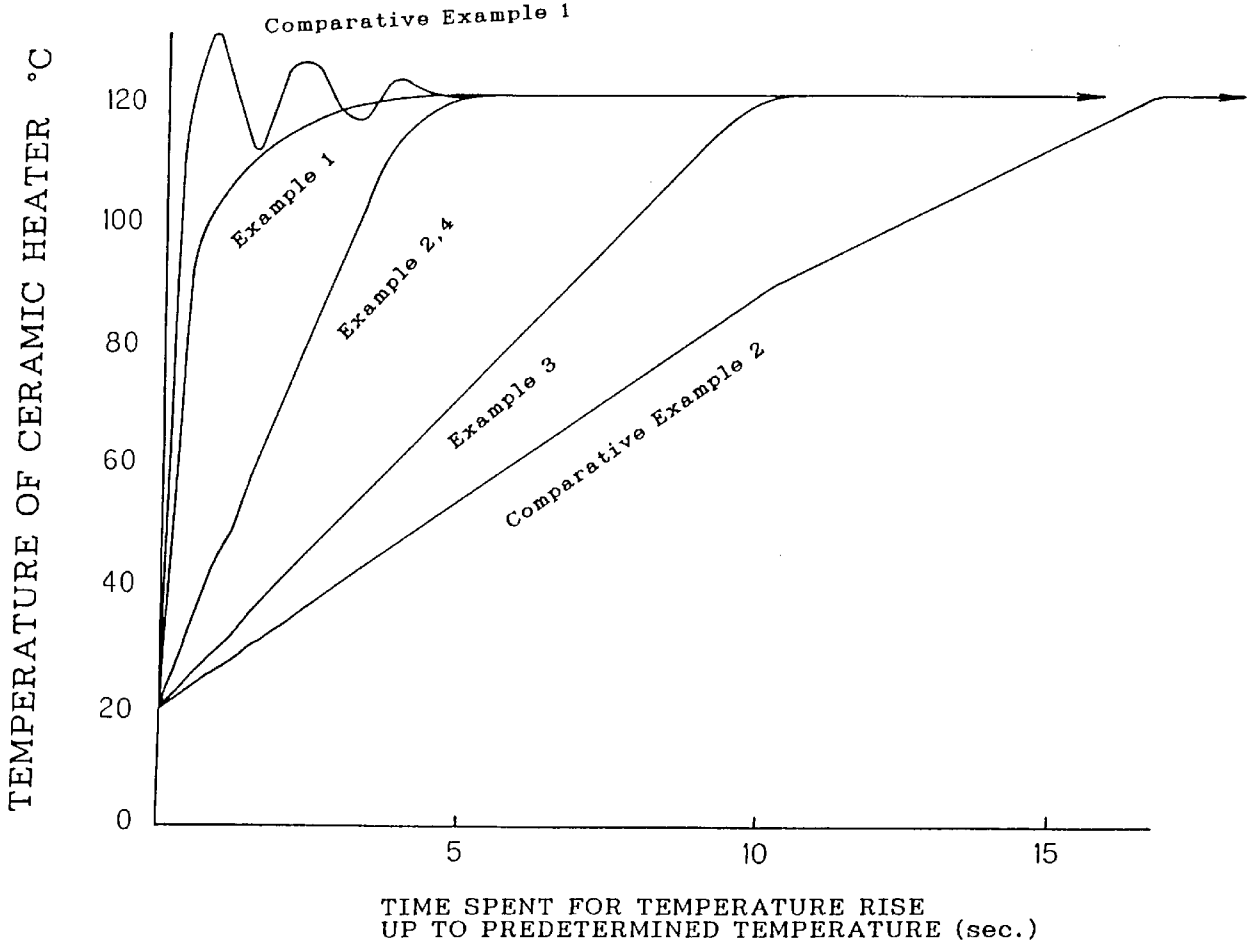
FIG. 2 is a graph showing a correlation of time and temperature rise of a ceramic heater.

A time spent for a temperature rise up to a predetermined one was obtained by measuring a time required for heating up the ceramic heater from 20° C. to 120° C. by applying a voltage of 100V to an external electrode constituted of a copper cable. A temperature precision was checked by measuring a temperature of the ceramic heater with the passage of time. Incidentally, a temperature of the ceramic heater was measured by inserting a thermocouple into a cavity 5 opened in a ceramic portion of the ceramic heater. Temperature was controlled by a combination of a phase control and PID control to the thermocouple. The time for a temperature rise and temperature precision are shown in Table 1. A curve of a temperature rise of the above ceramic heater is shown in FIG. 2.

(EXAMPLE 2)

A ceramic heater was produced in the same manner as in Example 1 except that a width and a thickness of a pattern consisting of a heating element were adjusted so as to have a resistance of 15Ω when an input voltage is 100V, i.e., in the range from 0.76Ω to 34.0Ω. A time spent for a temperature rise up to a predetermined one and temperature precision were checked in the same manner as in Example 1 and are shown in Table 1. A curve of a temperature rise of the above ceramic heater is shown in FIG. 2.

(EXAMPLE 3)

A ceramic heater was produced in the same manner as in Example 1 except that a width and a thickness of a pattern consisting of a heating element were adjusted so as to have a resistance of 34Ω when an input voltage is 100V, i.e., in the range from 0.76Ω to 34.0Ω. A time spent for a temperature rise up to a predetermined one and temperature precision were checked in the same manner as in Example 1 and are shown in Table 1. A curve of a temperature rise of the above ceramic heater is shown in FIG. 2.

(EXAMPLE 4)

A ceramic heater was produced in the same manner as in Example 2 except that molybdenum was used as a material for a heating element. A time spent for a temperature rise up to a predetermined one and temperature precision were checked in the same manner as in Example 1. Incidentally, a molybdenum paste was produced in the same manner as tungsten paste except that a molybdenum paste was used instead of a tungsten paste. A time spent for a temperature rise up to a predetermined one and temperature precision are shown in Table 1. A curve of a temperature rise of the above ceramic heater is shown in FIG. 2.

(COMPARATIVE EXAMPLE 1)

A ceramic heater was produced in the same manner as in Example 1 except that a width and a thickness of a pattern consisting of a heating element were adjusted so as to have a resistance of 0.6Ω when an input voltage is 100V, i.e., without the range from 0.76Ω to 34.0Ω. A time spent for a temperature rise up to a predetermined one and a temperature precision were checked in the same manner as in Example 1 and are shown in Table 1. A curve of a temperature rise of the above ceramic heater is shown in FIG. 2.

(COMPARATIVE EXAMPLE 2)

A ceramic heater was produced in the same manner as in Example 1 except that a width and a thickness of a pattern consisting of a heating element were adjusted so as to have a resistance of 40Ω when an input voltage is 100V, i.e., without the range from 0.76Ω to 34.0Ω. A time spent for a temperature rise up to a predetermined one and a temperature precision were checked in the same manner as in Example 1 and are shown in Table 1. A curve of a temperature rise of the above ceramic heater is shown in FIG. 2.

TABLE 1

| | Material for heating element | Resistance (Ω) | Time spent for temperature rise up to predetermind temperature | Temperature precision |
|---|---|---|---|---|
| Example 1 | tungsten | 0.8 | 4 seconds | Excellent |
| Example 2 | tungsten | 15 | 5 seconds | Excellent |
| Example 3 | tungsten | 34 | 10 seconds | Excellent |
| Example 4 | molybdenum | 15 | 5 seconds | Excellent |
| Comparative Example 1 | tungsten | 0.6 | 5 seconds | Bad |
| Comparative Example 2 | tungsten | 40 | 17 seconds | Excellent |

The ceramic heaters in Examples 1–4 were heated up from 20° to 120° C. within 10 seconds from the start of electrification. A temperature of each of the ceramic heaters did not exceed a predetermined temperature, and temperature precision was excellent.

On the other hand, though it took only 5 seconds for a ceramic heater in Comparative Example 1 to be heated up to a predetermined temperature of 120° C. from the start of electrification, a temperature of the ceramic heater exceeded the predetermined temperature within one second. Afterwards, a temperature of the ceramic heater exceeded the predetermined temperature several times. Temperature precision was not good. The reason seems to be that because of the too low resistance of the heating element, a current just after the start of electrification could not be controlled, which caused a sudden generation of heat. A ceramic heater in Comparative Example 2 took 17 seconds until a temperature of the ceramic heater reached the predetermined temperature of 120° C. The reason seems to be as follows. If a long time is spent for a temperature rise, an amount of radiant heat to the atmosphere increases. Accordingly, in spite of a large amount of electric power, a long time is required for a temperature rise up to a predetermined temperature.

A ceramic heater of the present invention has a structure that a heating element is embedded in aluminum nitride, and a resistance of the heating element is set to be a predetermined value. Accordingly, the heater can have a predetermined temperature in a very short time, and an efficiency of experiments can be sharply improved.

Further, since a resistance of the heating element is set up at a predetermined value or more, a sudden generation of heat in the early stage of electrification can be controlled, a temperature of the heater does not exceed the predetermined temperature, and an enzyme reaction can proceed without hindrance. Thus, a temperature of the heater can be controlled with high precision.

What is claimed is:

1. A ceramic heater comprising:

a body of aluminum nitride, and a heating element embedded in said body of aluminum nitride;

wherein said heating element has a resistance of $(E^2/W)\cdot 0.003\Omega$ to $(E^2/W)\cdot 0.135\Omega$, (where E and W denote an input voltage (unit: V) and a weight (unit: g) of the body of aluminum nitride, respectively.

2. A ceramic heater according to claim 1, wherein said heating element is made of tungsten or molybdenum.

3. A ceramic heater according to claim 2, wherein said ceramic heater has at least one cavity for receiving an object to be heated on a surface of said ceramic heater.

4. A ceramic heater according to claim 3, wherein said aluminum nitride body is a sintered body, and said embedded heating element is co-fired with said sintered body.

5. A ceramic heater according to claim 4, in combination with electrical power supply means adapted to supply power at voltage E to said heater.

6. A ceramic heater according to claim 3, in combination with electrical power supply means adapted to supply power at voltage E to said heater.

7. A ceramic heater according to claim 2, wherein said aluminum nitride body is a sintered body, and said embedded heating element is co-fired with said sintered body.

8. A ceramic heater according to claim 7, in combination with electrical power supply means adapted to supply power at voltage E to said heater.

9. A ceramic heater according to claim 2, in combination with electrical power supply means adapted to supply power at voltage E to said heater.

10. A ceramic heater according to claim 1, wherein said ceramic heater has at least one cavity for receiving an object to be heated on a surface of said ceramic heater.

11. A ceramic heater according to claim 10, wherein said aluminum nitride body is a sintered body, and said embedded heating element is co-fired with said sintered body.

12. A ceramic heater according to claim 11, in combination with electrical power supply means adapted to supply power at voltage E to said heater.

13. A ceramic heater according to claim 10, in combination with electrical power supply means adapted to supply power at voltage E to said heater.

14. A ceramic heater according to claim 1, wherein said aluminum nitride body is a sintered body, and said embedded heating element is co-fired with said sintered body.

15. A ceramic heater according to claim 14, in combination with electrical power supply means adapted to supply power at voltage E to said heater.

16. A ceramic heater according to claim 1, in combination with electrical power supply means adapted to supply power at voltage E to said heater.

* * * * *